US009670807B2

(12) United States Patent
Sotani et al.

(10) Patent No.: US 9,670,807 B2
(45) Date of Patent: Jun. 6, 2017

(54) BREATHER STRUCTURE FOR INTERNAL COMBUSTION ENGINE

(71) Applicant: HONDA MOTOR CO., LTD., Tokyo (JP)

(72) Inventors: Hiroshi Sotani, Wako (JP); Hiroshi Yokota, Wako (JP); Masaji Narushima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 125 days.

(21) Appl. No.: 14/792,335

(22) Filed: Jul. 6, 2015

(65) Prior Publication Data

US 2016/0010522 A1 Jan. 14, 2016

(30) Foreign Application Priority Data

Jul. 8, 2014 (JP) ..... 2014-140328

(51) Int. Cl.

| | |
|---|---|
| ***F01M 13/02*** | (2006.01) |
| ***F01M 13/00*** | (2006.01) |
| ***F01M 13/04*** | (2006.01) |
| *F01M 11/06* | (2006.01) |

(52) U.S. Cl.

CPC .... *F01M 13/0011* (2013.01); *F01M 13/0416* (2013.01); *F01M 11/065* (2013.01)

(58) Field of Classification Search

CPC ..... F01M 13/0011; F01M 13/0416; F01M 11/065

USPC ..... 123/572–574

See application file for complete search history.

(56) References Cited

U.S. PATENT DOCUMENTS

| | | | | |
|---|---|---|---|---|
| 4,589,382 | A * | 5/1986 | Tsuboi | F02B 61/02 123/196 R |
| 5,586,541 | A * | 12/1996 | Tsai | F01M 13/023 123/574 |
| 2006/0032486 | A1* | 2/2006 | Prasad | F01M 13/04 123/572 |
| 2010/0006076 | A1* | 1/2010 | Mavinahally | F01M 13/0011 123/574 |
| 2012/0048249 | A1* | 3/2012 | Liimatta | F01M 11/064 123/574 |

(Continued)

FOREIGN PATENT DOCUMENTS

| | | |
|---|---|---|
| JP | 05-171915 A | 7/1993 |
| JP | 2003-054484 A | 2/2003 |

*Primary Examiner* — Marguerite McMahon

(74) *Attorney, Agent, or Firm* — Birch, Stewart, Kolasch & Birch, LLP

(57) ABSTRACT

A ball valve includes a valve hole provided in an engine body to communicate with an inner end portion of a breather hole and is open in the engine body. A valve seat is formed on an inner surface of the engine body to coaxially surround the valve hole. A guide sleeve is in coaxially communication with the valve hole and the valve seat and is secured to the engine body at one end portion. A metallic valve element, formed to be ball-like with a predetermined weight is received to be rollable in the guide sleeve for enabling the closing of the valve hole and to be prevented from falling off the other end of the guide sleeve, is provided in the engine body so that the valve hole is placed within a moving range of oil in the engine body depending on the inclination of the engine body.

16 Claims, 8 Drawing Sheets

(56) References Cited

U.S. PATENT DOCUMENTS

2014/0034031 A1* 2/2014 Wagner ..... F01M 13/023
123/574

* cited by examiner

BREATHER STRUCTURE FOR INTERNAL COMBUSTION ENGINE

CROSS-REFERENCE TO RELATED APPLICATIONS

The present application claims priority under 35 USC 119 to Japanese Patent Application No. 2014-140328 filed Jul. 8, 2014 the entire contents of which are hereby incorporated by reference.

BACKGROUND OF THE INVENTION

1. Field of the Invention

The present invention relates to a breather structure for an internal combustion engine wherein a breather hole for mitigating the pressure in an engine body is provided in the engine body.

2. Description of Background Art

A technology is known for preventing the oil stored in an engine body of an internal combustion engine mounted on a motorcycle, from flowing out through a breather hole in the event that the motorcycle overturns. See, for example, JP-A No. H5-171915. Further, a technology is known that is designed for preventing oil from flowing out from a breather pipe connected to an engine body of an internal combustion engine mounted on a small planing boat in the event that the boat overturns. See, for example, JP-A No. 2003-54484.

In the technology in the aforementioned JP-A No. H5-171915, a breather hole opening to a breather chamber extending in a vehicle width direction and a pressure hole connecting a crankcase and the breather chamber are provided in the engine body to be spaced in the vehicle width direction wherein at least one of the breather hole and the pressure hole is placed above the surface of the oil in the crankcase in the event that the motorcycle overturns. This results in limiting the freedom in placement of the breather hole. Further, in the technology disclosed in JP-A No. 2003-54484, a breather box is placed above a connecting portion of the breather pipe to the engine body, and an intermediate portion of the breather pipe connecting the engine body and the breather box is placed lower than the connecting portion of the breather pipe to the engine body. This results in limiting the freedom in placement of the connecting portion of the breather pipe to the engine body.

SUMMARY AND OBJECTS OF THE INVENTION

The present invention has been achieved in view of the above-mentioned circumstances, and an object of an embodiment of the present invention is to provide a breather structure for an internal combustion engine that is designed to be capable of enhancing the freedom in placement of a breather hole and at the same time, preventing oil from flowing out from an engine body.

To attain this object, an embodiment of the present invention resides in a breather structure for an internal combustion engine that includes a breather hole that is provided in an engine body in order to mitigate the pressure in the engine body. The engine body is provided with a ball valve including a valve hole provided in the engine body to communicate with an inner end portion of the breather hole and to open in the engine body with a valve seat formed on an inner surface of the engine body to surround the valve hole coaxially. A guide sleeve is provided for coaxially communicating with the valve hole and the valve seat and is secured to the engine body at one end portion. A metallic valve element, formed to be ball-like with a predetermined weight and received to be rollable in the guide sleeve, is provided for enabling the closing of the valve hole when seated on the valve seat and to be prevented from falling off the other end of the guide sleeve. The ball valve is provided in the engine body so that the valve hole is placed within a moving range of oil in the engine body depending on the inclination of the engine body.

According to an embodiment of the present invention, an escape valve that opens when the maximum internal pressure is built inside the engine body with the operation of the internal combustion engine being provided in the engine body to bypass the ball valve and to be interposed between the inside of the engine body and the breather hole.

According to an embodiment of the present invention, the opening area of the valve hole and the dimensions of the valve element are set so that the valve element comes with its own weight to a position to open the valve hole even in the state that the maximum internal pressure is built inside the engine body with the operation of the internal combustion engine.

According to an embodiment of the present invention, a breather gas circulation hole, located closer to the valve hole than the valve element in the state that the valve element is moved to the side to open the valve hole, is provided in a peripheral wall of the guide sleeve to communicate with the inside of the engine body.

According to an embodiment of the present invention, a damping member for limiting the movement of the valve element toward the side to open the valve hole and at the same time, absorbing the vibration of the valve element is fixedly placed to abut on the valve element moved to the other end side of the guide sleeve.

According to an embodiment of the present invention, the engine body is mounted on a vehicle to take an ordinary posture with the vehicle grounded on a horizontal road surface. The engine body includes a cylinder section with a cylinder axis extending vertically in the ordinary posture and a power transmission case section incorporating a power transmission mechanism and being connected to a lower part of the cylinder section in the ordinary posture to project from the lower part of the cylinder section toward one lateral side. When viewed in a projected plan onto a plane orthogonal to an axis of a crankshaft rotatably supported in the engine body, an axis of the guide sleeve secured to an upper part of the cylinder section in the state of the engine body being in the ordinary posture is placed to be inclined toward the power transmission case section side and to extend in a direction crossing the cylinder axis.

According to an embodiment of the present invention, pressure detection means is provided for discontinuing the operation of the internal combustion engine upon detecting a pressure drop in oil occurring along with an inclination of the engine body. The pressure detection means is attached to the engine body to detect the pressure drop for discontinuation of the operation of the engine body before the valve element closes the valve element at the time of the inclination of the engine body.

According to an embodiment of the present invention, since the ball-like metallic valve element with the predetermined weight is received to be rollable in the guide sleeve which is fixed to the engine body at one end portion to coaxially communicate with the valve hole which in turn communicates with an inner end portion of the breather hole and since the valve hole is closed by the gravity acting on the valve element, the timing of the opening and closing the breather hole which accompanies the inclination of the engine body can be attained precisely in a simplified construction. In addition, since the valve hole communicating with the inner end portion of the breather hole is placed within the moving range of oil in the engine body depending on the inclination of the engine body, it is possible to enhance the freedom in placement of the breather hole.

According to an embodiment of the present invention, since the escape valve bypassing the ball valve is interposed between the inside of the engine body and the breather hole opens when the inside of the engine body comes into the state of building the maximum internal pressure, the internal pressure of the engine body can be prevented from becoming excessive even when a temporary phenomenon such as the action of the vibration to the engine body or the occurrence of a temporary inclination of the same brings about the state that the valve element closes the valve hole. Therefore, the pressure in the engine body can be mitigated.

According to an embodiment of the present invention, even when the state occurs in which the maximum internal pressure is built inside the engine body, the valve element moves with its own weight toward the side to open the valve hole. Thus, even when a temporary phenomenon such as the action of vibration to the engine body or the occurrence of a temporary inclination of the same brings about the state that the valve element closes the valve hole, the valve element can be prevented from sticking close to the valve seat with the valve hole kept closed. Therefore, it becomes possible to mitigate the internal pressure gently as a result of cancelling the aforementioned phenomenon.

According to an embodiment of the present invention, since the breather gas circulation hole communicating with the inside of the engine body comes into communication with the valve hole when the valve element moves to a position to open the valve hole, it can be realized to secure the flow of breather gas at the time of an ordinary operation of the internal combustion engine and at the same time, to make small the clearance between the guide sleeve and the valve element. Therefore, the valve element can be smoothened in movement as the valve element is restrained from rattling in the guide sleeve.

According to an embodiment of the present invention, the movement of the valve element toward the side to open the valve hole is limited by the damping member, and the vibration of the valve element is suppressed by the damping member. Thus, the movement of the valve element can be further smoothened, so that a high breather performance can be exhibited.

According to an embodiment of the present invention, the engine body mounted on the vehicle has the cylinder section with the cylinder axis extending vertically in the ordinary posture of the vehicle grounded on a horizontal road surface and the power transmission case section projecting from the lower part of the cylinder section toward one lateral side in the ordinary posture, wherein the axis of the guide sleeve secured to the upper part of the cylinder section is inclined to be directed toward the power transmission case section side to come across the cylinder axis in the projected plan onto the plane orthogonal to the axis of the crankshaft. Therefore, it is possible to attain a high breather performance adapted for the oil stored in the power transmission case section to flow into the cylinder section at a shallow angle.

According to an embodiment of the present invention, in the state wherein the engine body is inclined at the angle where the valve element closes the valve hole, the pressure detection means attached to the engine body detects a pressure drop that discontinues the operation of the internal combustion engine. Therefore, it is possible to restrain a pressure increase in the engine body which would otherwise result from the operation of the internal combustion engine in the state wherein the breather hole is closed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described with reference to accompanying FIGS. 1 to 8. In the following description, front-rear, right-left and upper-lower are referred to as those as viewed by an occupant operating the four-wheeled vehicle.

Figure 1:
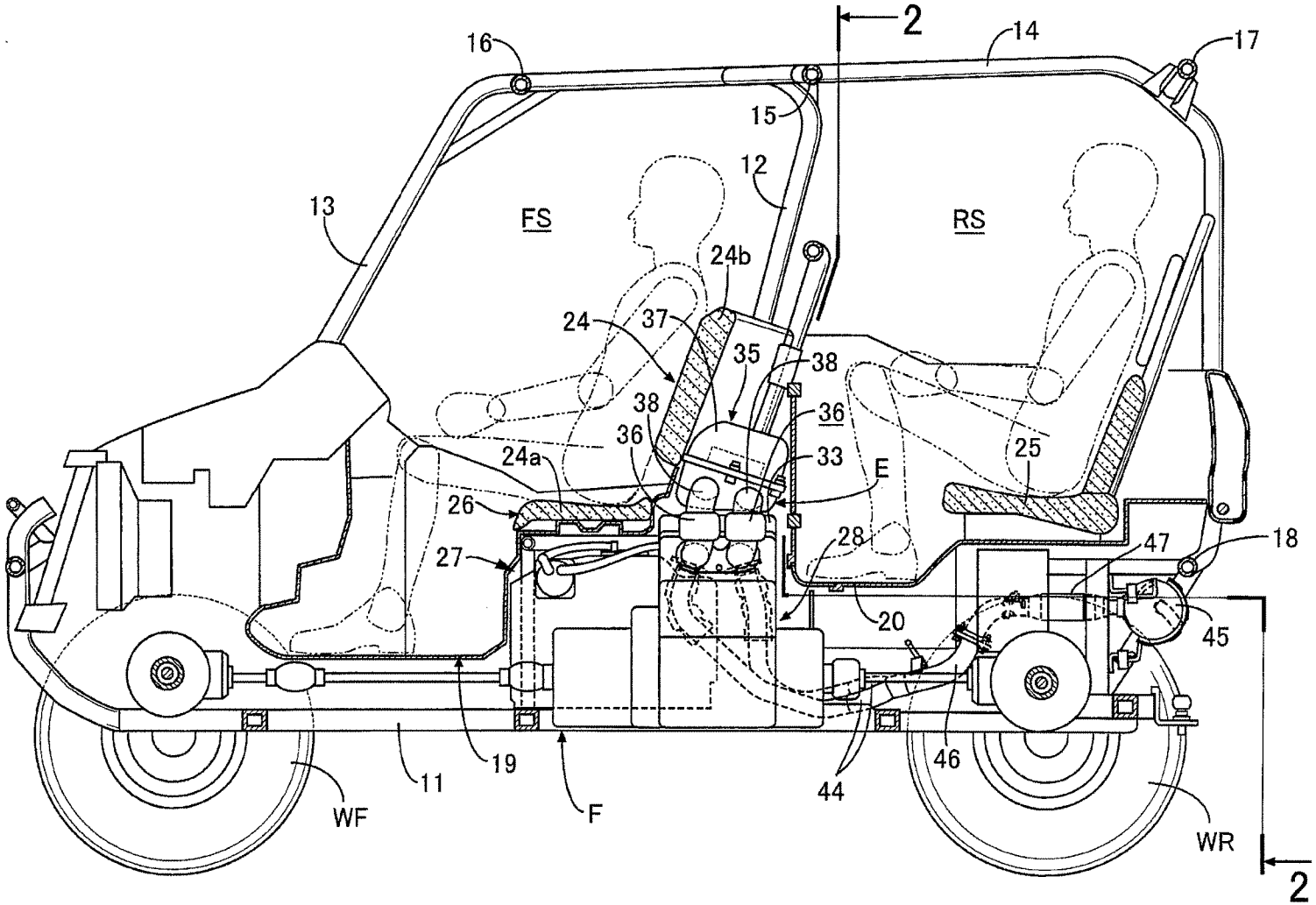
FIG. 1 is a longitudinal sectional view of a four-wheeled vehicle.
Figure 2:
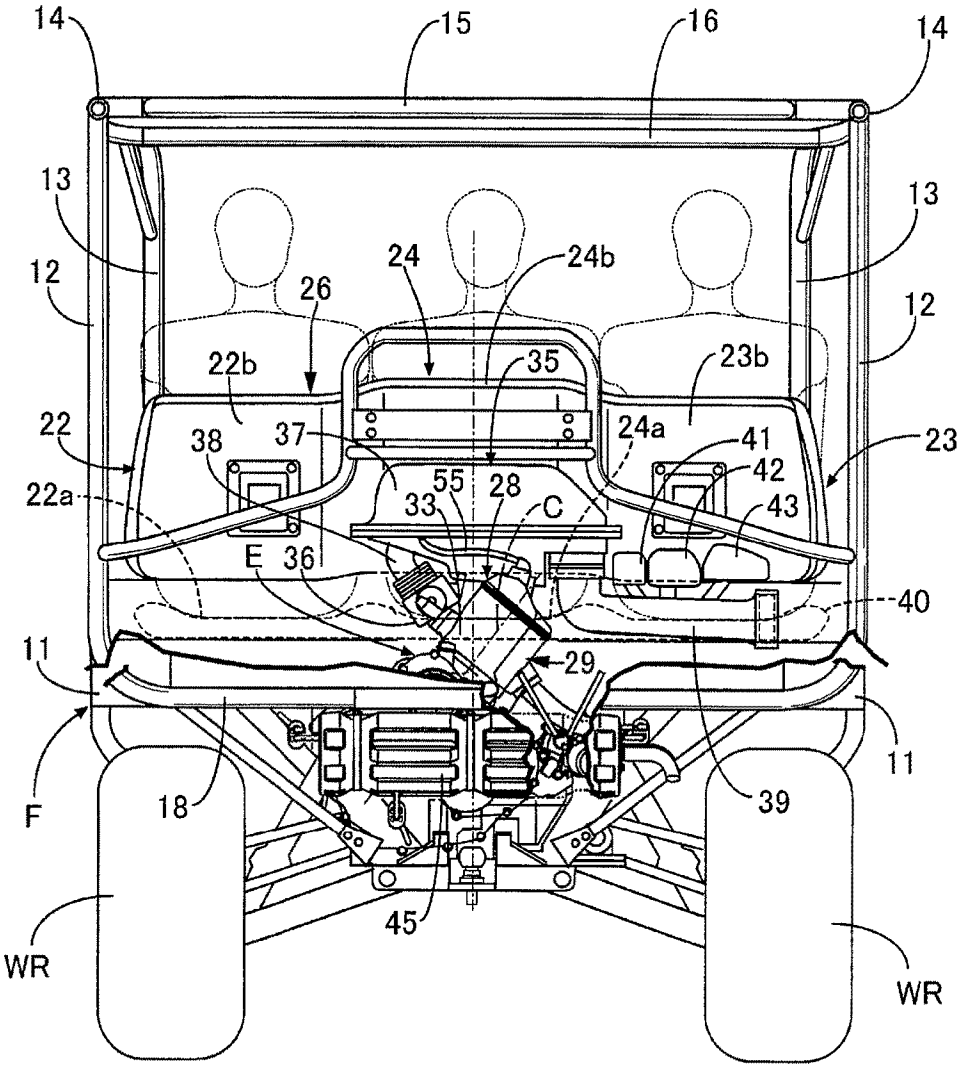
FIG. 2 is a sectional view taken along line 2-2 in FIG. 1.

As illustrated in FIG. 1 and FIG. 2, front wheels WF are suspended respectively from front right and left of a body frame F of the four-wheeled vehicle with rear wheels WR being suspended respectively from rear right and left of the body frame F.

The body frame F is provided with a pair of right and left lower frames 11 extending in the front-rear direction with a space in a vehicle width direction, a pair of right and left center upstanding frames 12 upstanding vertically at mid portions in the front-rear direction of the lower frames 11 with a pair of right and left front side frames 13 extending forward from upper ends of the center upstanding frames 12 and extending to descend forward from the middles to be connected respectively to front parts of the lower frames 11. A pair of right and left rear side frames 14 extend rearwardly from the upper ends of the center upstanding frames 12 and extending downwardly from the middles to be connected to rear parts of the lower frames 11. A center cross member 15 is provided for coupling the upper end portions of the pair of right and left center upstanding frames 12 with a front cross member 16 coupling mid bent portions of the pair of right and left front side frames 13. An upper rear cross member 17 is provided for coupling mid bent portions of the pair of right and left rear side frames 14 with a lower rear cross member 18 coupling lower portions of the pair of right and left rear side frames 14.

The pair of right and left center upstanding frames 12 and the pair of right and left front side frames 13 constitute an outer hull of a front occupant space FS for a driver and a front passenger. A front floor 19, arranged ahead of the center upstanding frames 12, is supported on a front part of the body frame F. Further, the pair of right and left center upstanding frames 12 and the pair of right and left rear side frames 14 constitute an outer hull of a rear occupant space RS for fellow passengers. A rear floor 20, arranged behind the center upstanding frames 12, is supported on a rear part of the body frame F.

In the front occupant space FS for the driver and the front passenger, a driver seat 22 and a front passenger seat 23, arranged on the right side of the driver seat 22, are arranged to be spaced in the vehicle width direction. The driver seat 22 and the front passenger seat 23 are connected through an intermediate connecting portion 24 functioning as a second front passenger seat.

The driver seat 22 and the front passenger seat 23 are respectively provided with seat portions 22*a*, 23*a* and backrest portions 22*b*, 23*b* upstanding upward from rear parts of the seat portions 22*a*, 23*b*. Further, the intermediate connecting portion 24 has a backrest portion 24*b* displaced forward relative to the backrest portions 22*b*, 23*b* and also has a seat portion 24*a* arranged between the seat portions 22*a*, 23*a* of the driver seat 22 and the front passenger seat 23. The driver seat 22, the front passenger seat 23 and the intermediate connecting portion 24 are integrated as a bench seat being long in the vehicle width direction, wherein the seat portions 22*a*, 23*a*, 24*a* and the backrest portions 22*b*, 23*b*, 24*b* are formed to be integrally connected. On the other hand, the rear occupant space RS for the fellow passengers is provided with a pair of right and left fellow passenger seats 25.

An upper surface of the front floor 19 serves as a foot rest surface for the occupants seated on the bench seat 26. A seat support frame 27 formed by jointing and combining a plurality of pipes to constitute a part of the body frame F is formed to stand upwardly from the front floor 19 with the bench seat 26 being supported on an upper end portion of the seat support frame 27.

On the body frame F, an engine body 28 of a two-cylinder internal combustion engine E that generates the power to rotationally drive the pair of right and left front wheels WF and the pair of right and left rear wheels WR is mounted to be placed at a mid-portion in the front-rear direction of the vehicle. The engine body 28 of the internal combustion engine E is arranged at a mid-portion in the longitudinal direction of the bench seat 26, that is, under the intermediate connecting portion 24.

Figure 3:
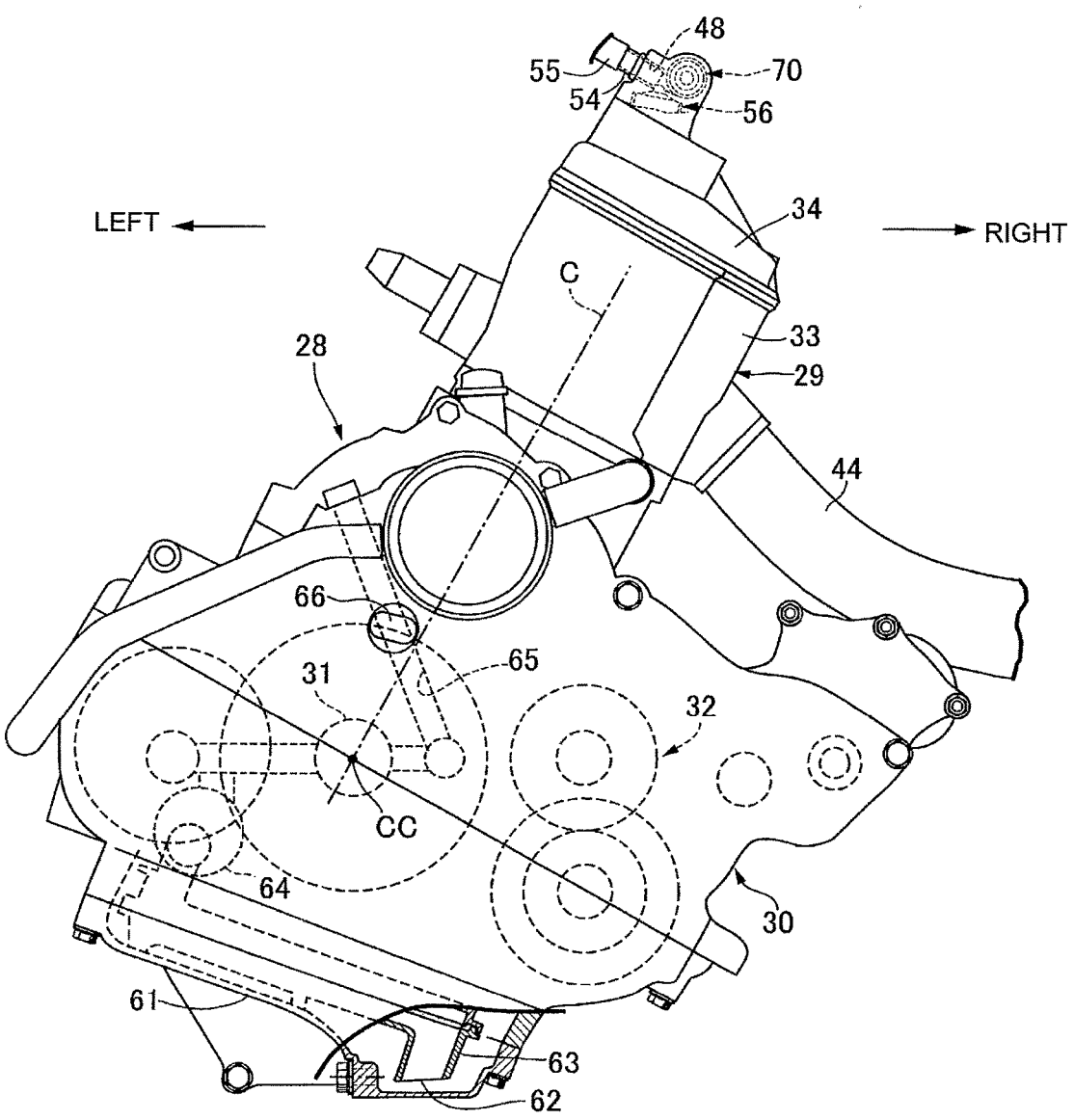
FIG. 3 is a view of an engine body as viewed in the same direction as FIG. 2.

Referring to FIG. 3, the engine body 28 is mounted on the body frame F to take an ordinary posture with the four-wheeled vehicle grounded on a horizontal road surface and comprises a cylinder section 29 with a cylinder axis C extending vertically in the ordinary posture and a power transmission case section 30 connected to a lower part of the cylinder section 29 in the ordinary posture to project from the lower part of the cylinder section 29 toward one lateral side. The power transmission case section 30 rotatably journals a crankshaft 31 with an axis extending in the vehicle width direction, and the power transmission case section 30 incorporates therein a power transmission mechanism 32 for transmitting the rotational power from the crankshaft 31 to the front wheels WF and the rear wheels WR.

In this embodiment, the cylinder axis C of the cylinder section 29 is inclined toward the front passenger seat 23 side in the vehicle width direction, that is, toward the right side, and the power transmission case section 30 is formed to project rightward from the lower part of the cylinder section 29.

A part of the cylinder section 29 is composed of a cylinder head 33 and a head cover 34 joined to an upper part of the cylinder head 33. An intake device 35 of the internal combustion engine E comprises a pair of throttle bodies 36 connected to a left side part of the cylinder head 33 for respective cylinders. An air cleaner 37 is disposed between the driver seat 22 and the front passenger seat 23 when viewed in a plan view with a pair of connecting tubes 38 connecting the pair of throttle bodies 36 to the air cleaner 37. A single air intake duct 39 is provided for leading air to the air cleaner 37.

The air intake duct 39 extends to the right side portion of the vehicle body along the backrest portion 23*b* of the front passenger seat 23, and at an upstream end of the air intake duct 39, a prefilter 40 made of a dry urethane is detachably packed to eliminate relatively large foreign matter. Further, resonators 41, 42, 43 are connected at a plurality of portions on the air intake duct 39.

Individual exhaust pipes 44 are connected to the right side portion of the cylinder head 33 for respective cylinders. On the other hand, an exhaust muffler 45 extending along a rear edge of the body frame F in the vehicle width direction is supported on the body frame F. A common exhaust pipe 46 connected in common to the individual exhaust pipes 44 is connected to the exhaust muffler 45 through a catalytic converter 47.

Usually, a breather hole 48 for mitigating the pressure in the engine body 28 is provided in the engine body 28, and in this embodiment, the breather hole 48 is provided at an upper part of the head cover 34 of the engine body 28 taking an ordinary posture in the state that the four-wheeled vehicle is grounded on a horizontal road surface.

Figure 4:
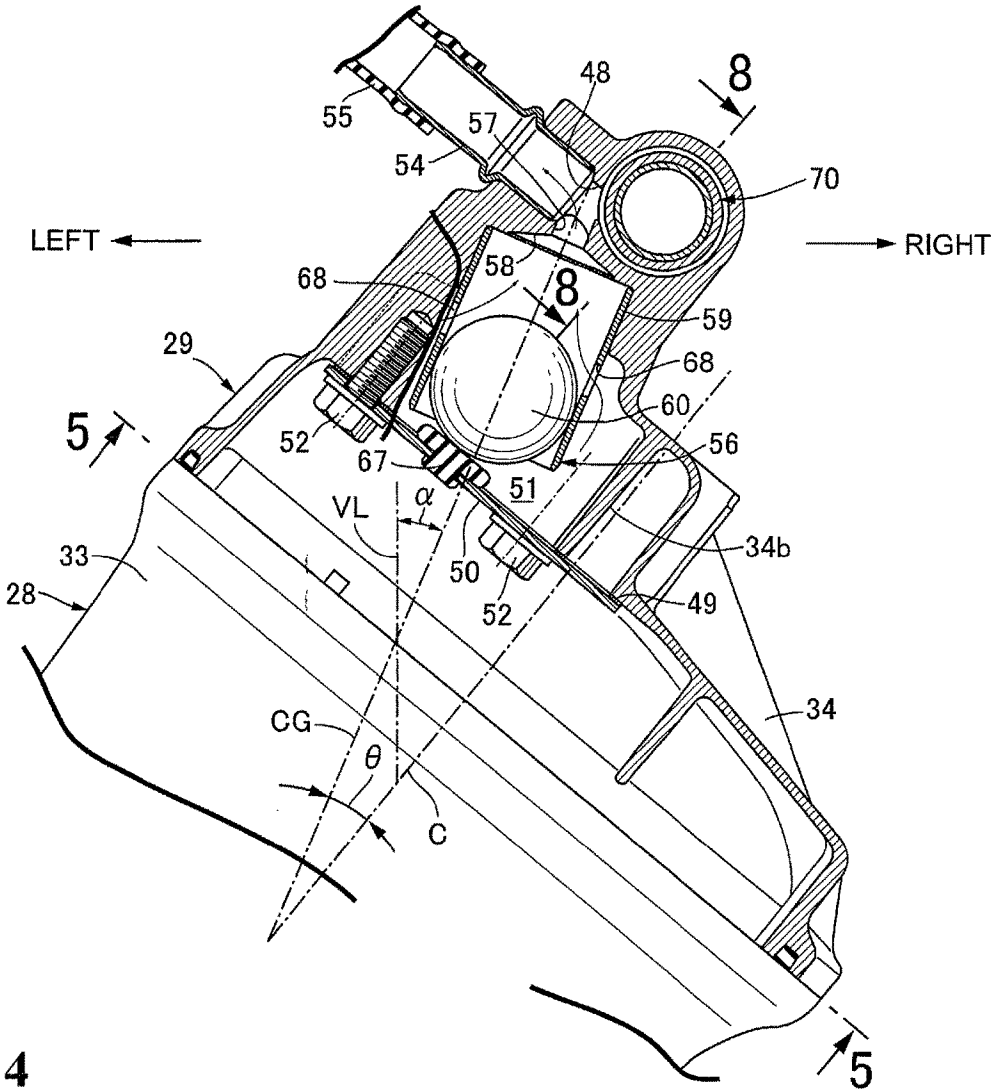
FIG. 4 is an enlarged, vertical sectional view of an upper part of the engine body.
Figure 5:
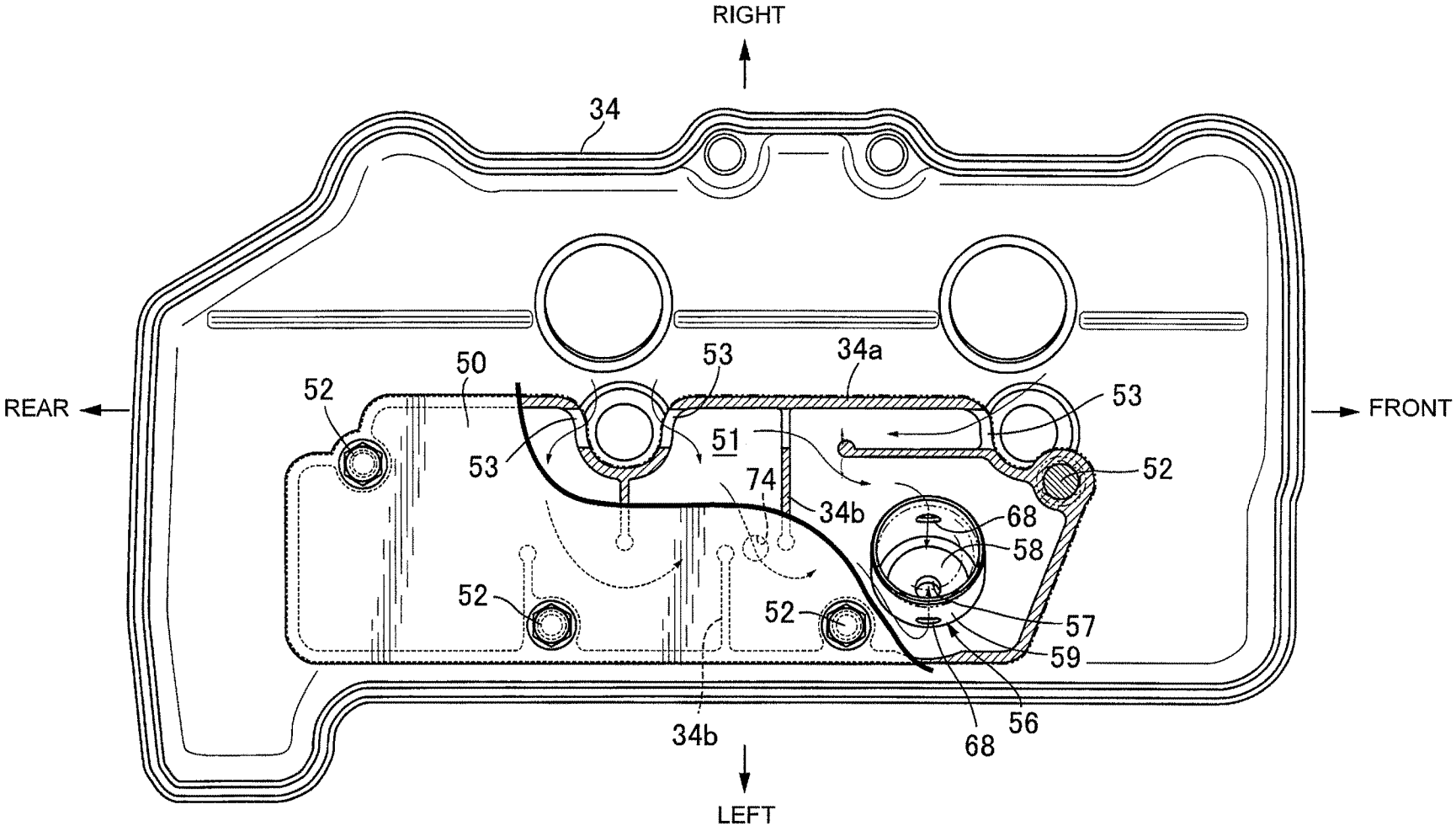
FIG. 5 is a view as viewed along an arrow of line 5-5 in FIG. 4.

Referring further to FIG. 4 and FIG. 5, a breather plate 50 having a gasket 49 interposed between itself and the head cover 34 is fastened by a plurality of bolts 52 to the head cover 34 to define a breather chamber 51 between itself and the head cover 34. The head cover 34 is integrally provided with a rib-like peripheral wall portion 34*a* that constitutes an outer hull of the breather chamber 51, and the peripheral wall portion 34*a* is formed with one or plurality of recess portions that define one or a plurality of inlet passages 53 between itself and the breather plate 50 for leading the breather gas from the cylinder head 33 side to the breather chamber 51.

A connection pipe 54 is press-fitted into an outer end portion of the breather hole 48, and the other end portion of a breather hose 55 whose one end portion is connected to the connection pipe 54 is connected to a clean side of the air cleaner 37.

The head cover 34 of the engine body 28 is provided with a ball valve 56 interposed between the breather hole 48 and the breather chamber 51. The ball valve 56 is composed of a valve hole 57 provided in the head cover 34 to communicate with an inner end portion of the breather hole 48 and to open to the breather chamber 51 in the engine body 28. A tapered valve seat 58 is coaxially formed on an inner surface of the head cover 34 to surround the valve hole 57. A guide sleeve 59 is coaxially connected to the valve hole 57 and the valve seat 58 and is secured to the head cover 34 at one end portion. A ball-like valve element 60 is received in the guide sleeve 59 to be rollable and is able to be seated on the valve seat 58 to close the valve hole 57. In addition, the ball valve 56 is provided in the head cover 34 of the engine body 28 with the valve hole 57 located within a moving range of oil in the engine body 28 depending on the inclination of the engine body 28.

One end portion of the guide sleeve 59 that coaxially communicates with the valve hole 57 and the valve seat 58 is fixed by press-fitting or the like to the head cover 34. In the guide sleeve 59, the valve element 60 having a predetermined weight and made of a metal such as stainless steel, iron or the like is received to be rollable so that the valve element 60 is able to be seated on the valve seat 58 to close the valve hole 57 on one hand and is prevented from falling off the other end of the guide sleeve 59 on the other hand.

The falling-off of the valve element 60 from the other end of the guide sleeve 59 is prevented by a damping member 67 that is attached to the breather plate 50 to abut on the valve element 60 when the same moves to the other end side of the guide sleeve 59. The damping member 67 is formed of an elastic material such as rubber or the like and limits the movement of the valve element 60 toward the side to open the valve hole 57 by abutting on the valve element 60 and at the same time, absorbs the vibration of the valve element 60.

Further, in a peripheral wall of the guide sleeve 59, a plurality of breather gas circulation holes 68, that are located closer to the valve hole 57 than the valve element 60 in the state that the valve element 60 is under the gravity acting toward the side to open the valve hole 57, are provided to communicate with the breather chamber 51 in the engine body 28. Accordingly, in the state that the valve element 60 is in position to open the valve hole 57, the breather gas in the breather chamber 51 is taken out of the breather hole 48 through the breather gas circulation holes 68, the interior of the guide sleeve 59 and the valve hole 57. Further, the head cover 34 is integrally provided with a plurality of ribbed wall portions 34*b* that define a labyrinth on the route from the inlet passages 53 to the breather gas circulation holes 68 within the breather chamber 51.

In the state that the vehicle is grounded on a horizontal road surface and thus that the engine body 28 takes an ordinary posture, the axis CG of the guide sleeve 59, when viewed in a projected plan onto a plane orthogonal to an axis CC (refer to FIG. 3) of the crankshaft 31, is arranged to be inclined toward the power transmission case section 30 side projecting to the right from the lower part of the cylinder section 29 in the engine body 28 and to extend in a direction crossing the cylinder axis C. In this embodiment, the cylinder axis C is inclined to the right in the vehicle width direction, whereas the axis CG of the guide sleeve 59 is placed to cross the cylinder axis C at an angle θ. In the state that the engine body 28 takes an ordinary posture, the axis CG of the guide sleeve 59 extends to be inclined rightward at an angle α, for example, 15 degrees, relative to a vertical line VL.

Figure 6:
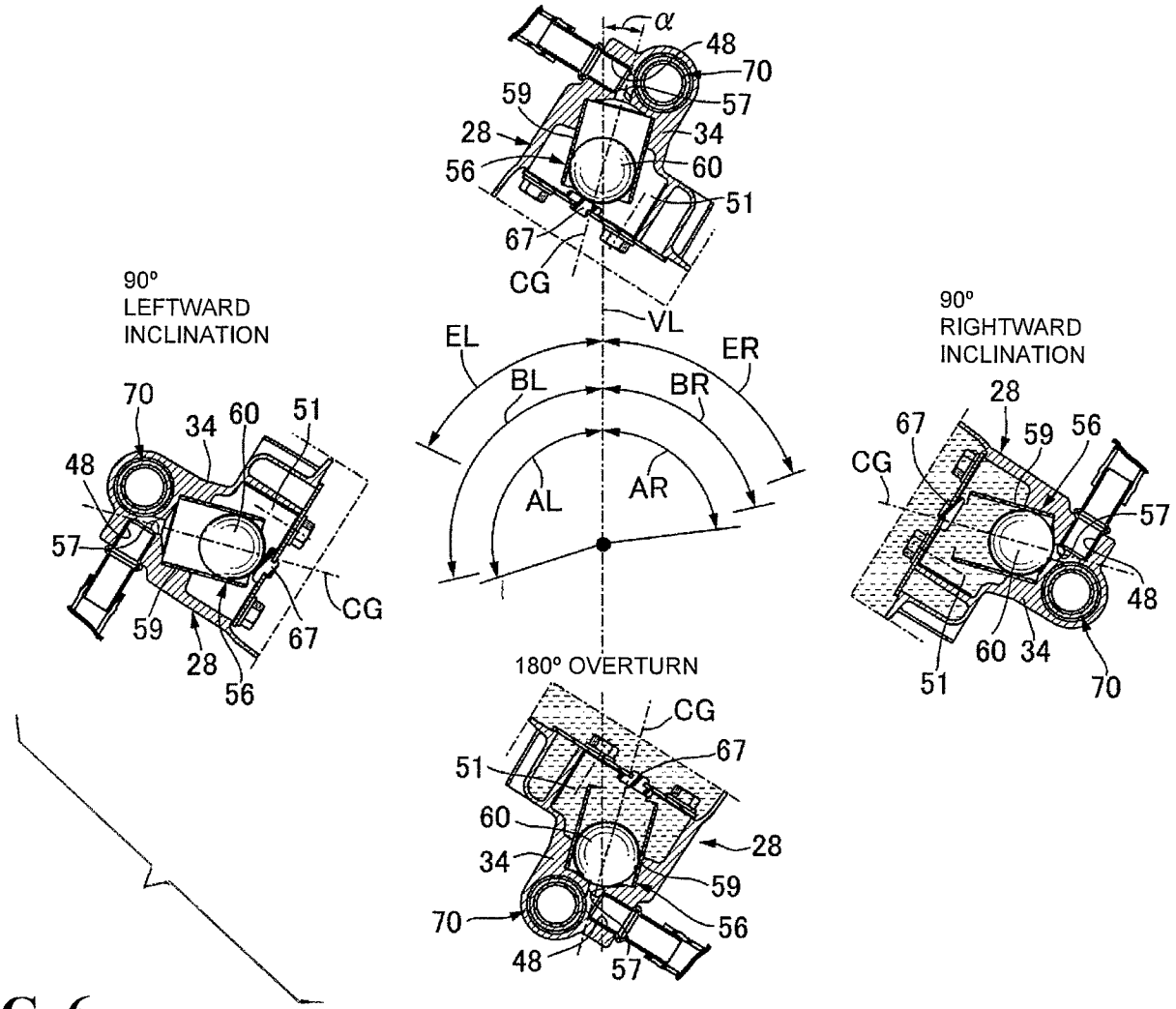
FIG. 6 is a view for explaining the operational states of a ball valve when a vehicle body is inclined in a right-left direction.

The ball valve 56 is one that is provided in the head cover 34 to place the valve hole 57 within the moving range of oil in the engine body 28 depending on the inclination of the engine body 28. As shown in FIG. 6, in this embodiment, the position of the valve hole 57 is determined so that the oil reaches the valve hole 57 when the engine body 28 is inclined to the right from the ordinary posture at an angle AR, for example, 80 degrees and that the oil reaches the valve hole 57 when the engine body 28 is inclined to the left from the ordinary posture at an angle AL, for example, 110 degrees. In this case, although the oil would flow out onto the air cleaner 37 side unless the valve hole 57 is closed, the valve element 60 in the guide sleeve 59 rolls in the guide sleeve 59 to close the valve hole 57 when the engine body 28 is inclined to the right from the ordinary posture at a smaller angle BR, for example, 75 degrees than the angle AR, and to close the valve hole 57 when the engine body 28 is inclined to the left from the ordinary posture at a smaller angle BL, for example, 105 degrees than the angle AL. That is, the valve hole 57 is closed by the valve element 60 with the engine body 28 is inclined to the right from the ordinary posture at the angle of 90 degrees, the valve element 60 does not move to the position to close the valve hole 57 with the engine body 28 inclined to the left from the ordinary posture at the angle of 90 degrees, and the valve hole 57 is closed by the valve element 60 with the engine body 28 being in the overturning state in which the engine body is inclined either to the right or left from the ordinary posture at the angle of 180 degrees.

Figure 7:
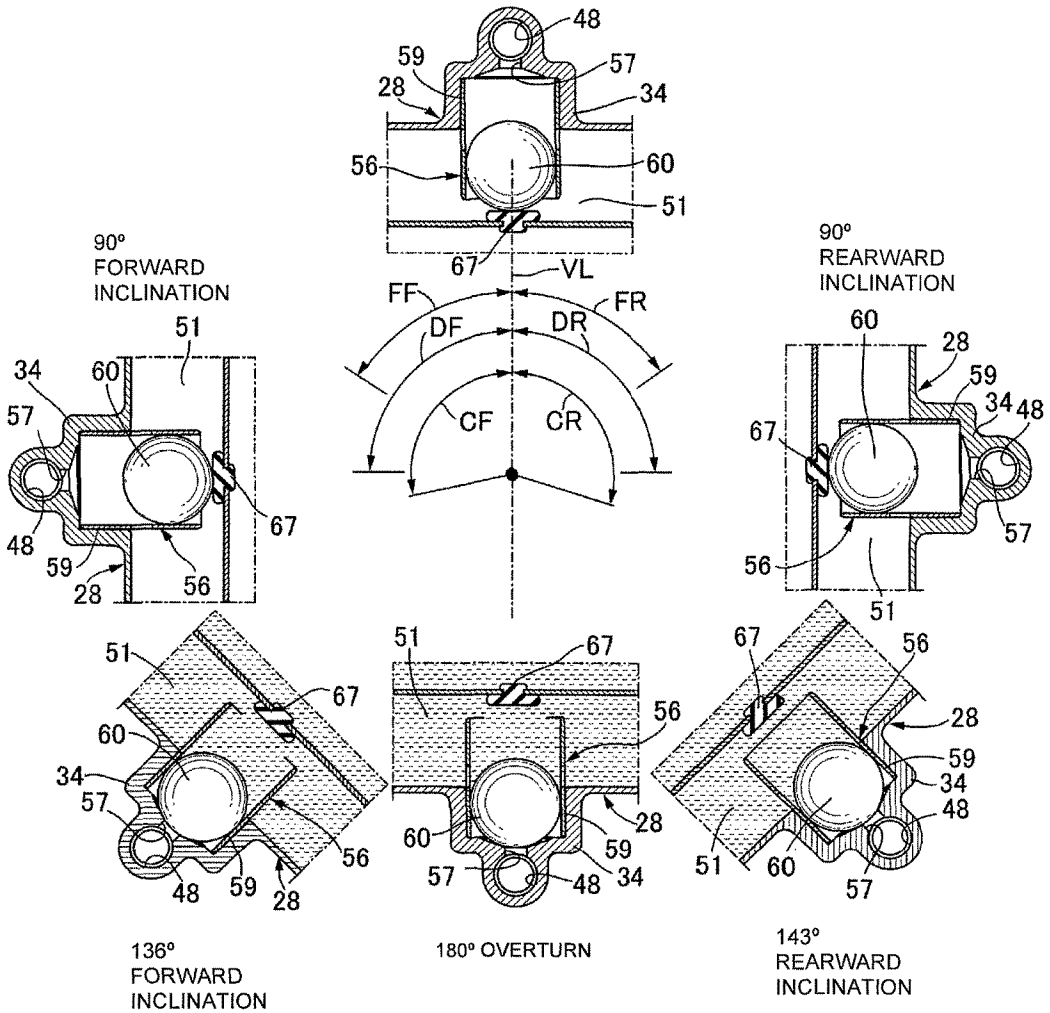
FIG. 7 is a view for explaining the operational states of the ball valve when the vehicle body is inclined in a front-rear direction.

Further, as shown in FIG. 7, although the oil reaches the valve hole 57 in the state that the engine body 28 is inclined from the ordinary posture either forward at an angle CF, for example, 105 degrees, or rearward at an angle CR, for example, 105 degrees, the valve element 60 in the guide sleeve 59 rolls in the guide sleeve 59 to close the valve hole 57 when the engine body 28 is inclined from the ordinary posture forward at a smaller angle DF, for example, 90 degrees than the angle CF, and to close the valve hole 57 when the engine body 28 is inclined from the ordinary posture rearward at a smaller angle DR, for example, 90 degrees than the angle CR. In other words, in the state that the inclination angle of the engine body 28 from the ordinary posture either forward or rearward does not reach 90 degrees, the valve element 60 does not move to the position to close the valve hole 57. However, when the engine body 28 is inclined from the ordinary posture either forward or rearward beyond 90 degrees, the valve hole 57 is closed by the valve element 60 as illustrated respectively as a state of being inclined forward at the angle of 136 degrees, a state of being inclined to the rear at the angle of 143 degrees and a state of being overturned at the angle of 180 degrees.

Referring to FIG. 3, the lowest portion of the power transmission case section 30 in the engine body 28 includes an oil pan 61, and in this oil pan 61, there is received and fixed an oil strainer 63 that has an inlet port 62 being close to and facing a bottom part of the oil pan 61. The oil in the oil pan 61 is pumped up by an oil pump 64 operating together with the crankshaft 31, through the oil strainer 63. The oil discharged from the oil pump 64 is supplied to a plurality of parts to be lubricated in the engine body 28 through an oil passage 65 provided in the engine body 28.

However, the operation of the internal combustion engine E is to be discontinued when the inclination of the engine body 28 causes the surface of the oil in the oil pan 61 to reach such a position that makes the oil unable to be sucked from the inlet port 62 of the oil strainer 63. Thus, pressure detection means 66 for detecting an oil pressure drop in the oil passage 65 to a level needing the discontinuation of the operation of the internal combustion engine E is attached to, for example, the power transmission case section 30 of the engine body 28.

Furthermore, the pressure detection means 66 is attached to the power transmission case section 30 of the engine body 28 so as to detect the oil pressure drop for use in discontinuing the operation of the internal combustion engine E before the valve element 60 closes the valve hole 57 at the time of an inclination of the engine body 28.

More specifically, in the case of the engine body 28 being inclined in the right-left direction, as shown in FIG. 6, when the engine body 28 is inclined from the ordinary posture to the right at a smaller angle ER, for example, 70 degrees than the angle BR, for example, 75 degrees, the pressure detection means 66 detects the oil pressure drop for use in discontinuing the operation of the internal combustion engine E. When the engine body 28 is inclined from the ordinary posture to the left at a smaller angle EL, for example, 75 degrees than the angle BL, for example, 105 degrees, the pressure detection means 66 detects the oil pressure drop for use in discontinuing the operation of the internal combustion engine E. Further, in the case of the engine body 28 being inclined in the front-rear direction, as shown in FIG. 7, when the engine body 28 is inclined from the ordinary posture forward at a smaller angle FF, for example, 75 degrees than the angle DF, for example, 90 degrees, the pressure detection means 66 detects the oil pressure drop for use in discontinuing the operation of the internal combustion engine E. When the engine body 28 is inclined from the ordinary posture to the rear at a smaller angle FR, for example, 75 degrees than the angle DR, for example, 90 degrees, the pressure detection means 66 detects the oil pressure drop for use in discontinuing the operation of the internal combustion engine E.

There is some delay from the time when the pressure detection means 66 detects the oil pressure drop for use in discontinuing the operation of the internal combustion engine E to the time when the operation of the internal combustion engine E is actually discontinued. Thus, there arises a possibility that the pressure in the engine body 28 is somewhat increased by the operation of the internal combustion engine E in the state that the valve element 60 closes the valve hole 57 communicating with the inner end portion of the breather hole 48. There also arises a possibility that if the pressure causes the valve element 60 to stick close to the valve seat 58 with the valve hole 57 kept closed, the breather hole 48 remains closed when the engine body 28 returns to the ordinary posture. With this taken into account, the opening area of the valve hole 57 and the dimensions of the valve element 60 are set so that the valve element 60 comes with its own weight to a position to open the valve hole 57 even in the state that the maximum internal pressure is built inside the engine body 28 to accompany the operation of the internal combustion engine E.

Figure 8:
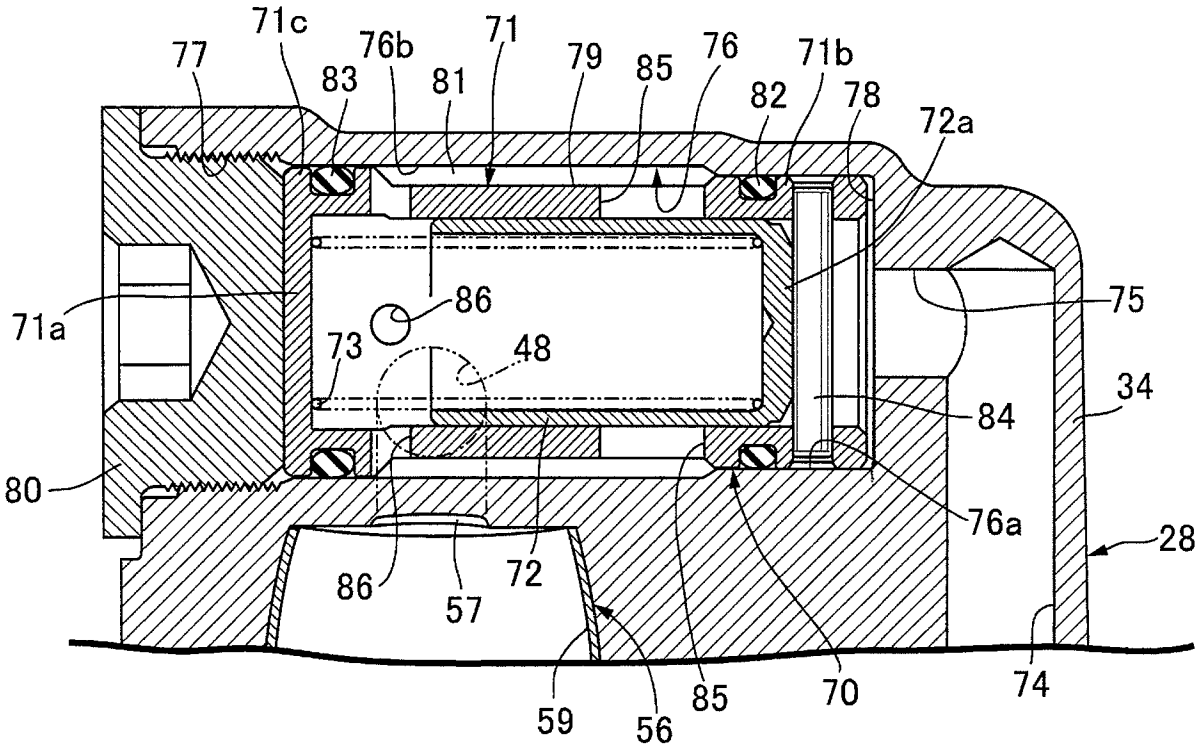
FIG. 8 is a sectional view taken along line 8-8 in FIG. 4.

Referring to FIG. 8, in the head cover 34 of the engine body 28, an escape valve 70 that is opened when the maximum internal pressure is built inside the engine body 28 with the operation of the internal combustion engine E is provided to bypass the ball valve 56 and to be interposed between the breather chamber 51 and the breather hole 48 in the engine body 28.

The escape valve 70 comprises a valve housing 71 received in the head cover 34, a spool valve member 72 fitted slidably in the valve housing 71 and a valve spring 73 compressedly provided between the valve housing 71 and the spool valve member 72.

The head cover 34 is provided with a passage 74 extending in a direction to go along the cylinder axes C at a position offset from the guide sleeve 59 and opening its one end portion to the breather chamber 51, a communication hole 75 orthogonally intersecting and communicating with the other end portion of the passage 74, a valve receiving hole 76 coaxially connected to the communication hole 75 at one end portion, and a threaded hole 77 coaxially connected to the other end of the valve receiving hole 76 at one end thereof and opening to an outer surface of the head cover 34 at the other end portion thereof.

The valve receiving hole 76 is composed of a small-diameter hole portion 76*a* that defines an annular step portion 78 facing on the opposite side of the passage 74 between itself and the communication hole 75 and that is coaxially connected to the communication hole 75 at one end portion, and a large-diameter hole portion 76*b* that is formed to be larger in diameter than the small-diameter hole portion 76*a* and that is coaxially connected to the small-diameter hole portion 76*a*, wherein the threaded hole 77 being larger in diameter than the large-diameter hole portion 76*b* is coaxially connected to the other end portion of the large-diameter hole portion 76*b*.

The valve housing 71 is formed to take a bottomed, stepped cylindrical shape having an end wall 71*a* on the opposite side of the communication hole 75. The valve housing 71 comprises a small-diameter cylindrical portion 71*b* fitted in the small-diameter hole portion 76*a* of the valve receiving hole 76 and a large-diameter cylindrical portion 71*c* fitted in the large-diameter hole portion 76*b* of the valve receiving hole 76, wherein an annular recess portion 79 is provided between the small-diameter cylindrical portion 71*b* and the large-diameter cylindrical portion 71*c* on an outer periphery of the valve housing 71.

The valve housing 71 is fitted into the valve receiving hole 76 to a position where its opening end comes close to and faces the step portion 78. A plug member 80 is screw-engaged with the threaded hole 77 for preventing the valve housing 71 from coming off the valve receiving hole 76, wherein the plug member 80 is brought to abutting on the end wall 71*a* of the valve housing 71.

The annular recess portion 79 of the valve housing 71 and the large-diameter hole portion 76*b* of the valve receiving hole 76 define an annular passage 81, which communicates with the inner end portion of the breather hole 48. In addition, the outer periphery of the small-diameter cylindrical portion 71*b* of the valve housing 71 has fitted thereon a first seal member 82 of an annular shape held in elastic contact with the internal surface of the small-diameter hole portion 76*a* of the valve receiving hole 76, while the outer periphery of the large-diameter cylindrical portion 71*c* of the valve housing 71 has fitted thereon a second seal member 83 of an annular shape held in elastic contact with the internal surface of the large-diameter hole portion 76*b* of the valve receiving hole 76.

The spool valve member 72 slidably fitted in the valve housing 71 is formed to take a bottomed cylindrical shape having an end wall 72*a* on the axially opposite side of the end wall 71*a* of the valve housing 71, and the coil-like valve spring 73 is compressedly provided between the end wall 71*a* of the valve housing 71 and the end wall 72*a* of the spool valve member 72. Further, a pin 84 extending on a certain diametrical line of the small-diameter cylindrical portion 71*b* is fitted and held at opposite end portions thereof in the small-diameter cylindrical portion 71*b* of the valve housing 71. Thus, a moving end of the spool valve member 72 toward the communication hole 75 side is limited when the end wall 72*a* of the spool valve member 72 abuts on the pin 84.

At an end portion on the small-diameter cylindrical portion 71*b* side of the portion where the annular recess portion 79 is provided, the valve housing 71 is provided with a plurality of through holes 85 communicating with the annular passage 81 with spaces therebetween in the circumferential direction. Further, at an end portion on the large-diameter cylindrical portion 71*c* side of the portion where the annular recess portion 79 is provided, the valve housing 71 is provided with a plurality of through holes 86 communicating with the annular passage 81 with spaces therebetween in the circumferential direction.

In an escape valve 70 like this, when the maximum internal pressure is built inside the engine body 28, a force in a valve opening direction that acts on the spool valve member 72 exceeds a force in a valve-closing direction of the valve spring 73. Thus, the spool valve member 72 slides to a position where it makes the through holes 85 communicate with the communication hole 75, whereby the breather chamber 51 is brought into communication with the breather hole 48 through the passage 74, the communication hole 75, the interior of the spool valve member 72, the through holes 85 and the annular passage 81.

Next, the operation of the embodiment will be described. The ball valve 56, comprising the valve hole 57 provided in the head cover 34 to communicate with the inner end portion of the breather hole 48 is provided in the head cover 34 of the engine body 28 and to open in the engine body 28. The valve seat 58 is formed on the inner surface of the head cover 34 to surround the valve hole 57 coaxially. The guide sleeve 59 coaxially communicates with the valve hole 57 and the valve seat 58 and is secured to the head cover 34 at one end portion. The metallic valve element 60, formed to be ball-like with a predetermined weight and received to be rollable in the guide sleeve 59 for enabling the closing of the valve hole 57 when seated on the valve seat 58 and to be prevented from falling off the other end of the guide sleeve 59, is provided in the head cover 34 of the engine body 28 so that the valve hole 57 is placed within the moving range in the engine body 28 of the oil depending on the inclination of the engine body 28. Therefore, the timing of opening and closing of the breather hole 48 in dependence on the inclination of the engine body 28 can be taken precisely with a simplified structure. In addition, since the valve hole 57 communicating with the inner end portion of the breather hole 48 is placed within the moving range of oil in the engine body 28 depending on the inclination of the engine body 28, it is possible to enhance the freedom in arranging the breather hole 48.

Further, since the escape valve 70 that opens when the maximum internal pressure is built inside the engine body 28 with the operation of the internal combustion engine E is provided in the head cover 34 to bypass the ball valve 56 and to be interposed between the inside of the engine body 28 and the breather hole 48, the internal pressure in the engine body 28 can be prevented from becoming excessive even when a temporary phenomenon such as the action of vibration to the engine body 28 or the occurrence of a temporary inclination of the engine body 28 causes the valve element 60 to close the valve hole 57, so that the pressure in the engine body 28 can be mitigated.

Further, the opening area of the valve hole 57 and the dimensions of the valve element 60 are set so that the valve element 60 comes with its own weight to the position to open the valve hole 57 even in the state where the maximum internal pressure is built inside the engine body 28 with the operation of the internal combustion engine E. Thus, even when a state arises in which a temporary phenomenon such as the action of the vibration to the engine body 28 or the occurrence of a temporary inclination of the engine body 28 causes the valve element 60 to close the valve hole 57, the valve element 60 is prevented from sticking close to the valve seat 58 with the valve hole 57 kept closed, so that the internal pressure can be gently mitigated as a result of the cancellation of the aforementioned phenomenon.

Further, the breather gas circulation holes 68 that are located at the position closer to the valve hole 57 than the valve element 60 in the state of the valve element 60 moved to the side to open the valve hole 57 are provided in the peripheral wall of the guide sleeve 59 to communicate with the inside of the engine body 28. Thus, the flow of the breather gas during an ordinary operation of the internal combustion engine E can be secured. In addition, at the same time, the clearance between the guide sleeve 59 and the valve element 60 can be made to be small, so that the movement of the valve element 60 can be smoothened while the valve element 60 is prevented from rattling in the guide sleeve 59.

Further, since the damping member 67 that absorbs the vibration of the valve element 60 while limiting the movement of the valve element 60 toward the side to open the valve hole 57 is fixedly disposed to abut on the valve element 60 moved to the other end side of the guide sleeve 59, the movement of the valve element 60 can be smoothened further, so that the performance of the breather can be enhanced.

Further, the engine body 28, mounted on the vehicle to take an ordinary posture with the vehicle grounded on a horizontal road surface, comprises the cylinder section 29 with the cylinder axis C extending vertically in the ordinary posture and the power transmission case section 30 incorporating the power transmission mechanism 32 and connected to the lower part of the cylinder section 29 in the ordinary posture to project from the lower part of the cylinder section 29 toward one lateral side. When viewed in a projected plan onto a plane orthogonal to the axis CC of the crankshaft 31 rotatably supported in the engine body 28, the axis CG of the guide sleeve 59 secured to the upper part of the cylinder section 29 in the state of the engine body 28 being in the ordinary posture is disposed to be inclined toward the power transmission case section 30 side and to extend in the direction crossing the cylinder axis C. Therefore, the breather structure can exhibit a high breather performance capable of coping with a flow of the oil stored in the power transmission case section 30 into the cylinder section 29 at a shallow angle.

Further, the pressure detection means 66 for discontinuing the operation of the internal combustion engine E upon detecting a pressure drop in oil that results from an inclination of the engine body 28 is attached to the engine body 28 to detect the pressure drop for use in discontinuing the operation of the internal combustion engine E before the valve element 60 closes the valve hole 57 at the time of the inclination of the engine body 28. Thus, in the state wherein the engine body 28 is inclined to the position where the valve element 60 closes the valve hole 57 communicating with the inner end portion of the breather hole 48, the pressure detection means 66 attached to the engine body 28 detects the oil pressure drop that results in discontinuing the operation of the internal combustion engine E. Therefore, it is possible to suppress a pressure increase in the engine body 28 that would otherwise result from the operation of the internal combustion engine E in the state of the breather hole 48 being closed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A breather structure for an internal combustion engine comprising:

a breather hole provided in an engine body for mitigating the pressure in the engine body;

wherein the engine body is provided with a ball valve including:

a valve hole provided in the engine body to communicate with an inner end portion of the breather hole, said valve hole being open to within the engine body;

a valve seat formed on an inner surface of the engine body to coaxially surround the valve hole;

a guide sleeve coaxially communicating with the valve hole and the valve seat and secured to the engine body at one end portion; and a metallic valve element formed to be ball-like with a predetermined weight and received to be rollable in the guide sleeve for enabling the closing of the valve hole when seated on the valve seat and to be prevented from falling off the other end of the guide sleeve;

wherein the ball valve is provided in the engine body so that the valve hole is positioned in a moving range of oil in the engine body depending on an inclination of the engine body; and a damping member for limiting a movement of the valve element towards a side to open the valve hole and for absorbing a vibration of the valve element, said damping member being fixedly placed to abut on the valve element moved within the guide sleeve.

2. The breather structure for the internal combustion engine according to claim 1, wherein an escape valve, that opens when a maximum internal pressure increases within the engine body with the operation of the internal combustion engine, is provided in the engine body to bypass the ball valve and to be interposed between the inside of the engine body and the breather hole.

3. The breather structure for the internal combustion engine according to claim 1, wherein the opening area of the valve hole and the dimensions of the valve element are set so that a weight of the valve element moves the valve element to a position to open the valve hole even in a state wherein the maximum internal pressure increases within the engine body with the operation of the internal combustion engine.

4. The breather structure for the internal combustion engine according to claim 1, wherein a breather gas circulation hole located closer to the valve hole than the valve element in a state that the valve element moves to a side to open the valve hole is provided in a peripheral wall of the guide sleeve to communicate with the inside of the engine body.

5. The breather structure for the internal combustion engine according to claim 2, wherein a breather gas circulation hole located closer to the valve hole than the valve element in a state that the valve element moves to the side to open the valve hole is provided in a peripheral wall of the guide sleeve to communicate with the inside of the engine body.

6. The breather structure for the internal combustion engine according to claim 3, wherein a breather gas circulation hole located closer to the valve hole than the valve element in a state that the valve element moves to the side to open the valve hole is provided in a peripheral wall of the guide sleeve to communicate with the inside of the engine body.

7. The breather structure for the internal combustion engine according to claim 1, wherein the engine body mounted on a vehicle to take an ordinary posture with the vehicle grounded on a horizontal road surface includes:

a cylinder section with a cylinder axis extending vertically in the ordinary posture; and a power transmission case section incorporating a power transmission mechanism and connected to a lower part of the cylinder section in the ordinary posture to project from the lower part of the cylinder section toward one lateral side; and wherein when viewed in a projected plan onto a plane orthogonal to an axis of a crankshaft rotatably supported in the engine body, an axis of the guide sleeve fixed to an upper part of the cylinder section in the state of the engine body being in an ordinary posture is placed to be inclined toward the power transmission case section side and to extend in a direction crossing the cylinder axis.

8. The breather structure for the internal combustion engine according to claim 2, wherein the engine body mounted on a vehicle to take an ordinary posture with the vehicle grounded on a horizontal road surface includes:

a cylinder section with a cylinder axis extending vertically in the ordinary posture; and a power transmission case section incorporating a power transmission mechanism and connected to a lower part of the cylinder section in the ordinary posture to project from the lower part of the cylinder section toward one lateral side; and wherein when viewed in a projected plan onto a plane orthogonal to an axis of a crankshaft rotatably supported in the engine body, an axis of the guide sleeve fixed to an upper part of the cylinder section in the state of the engine body being in an ordinary posture is placed to be inclined toward the power transmission case section side and to extend in a direction crossing the cylinder axis.

9. The breather structure for the internal combustion engine according to claim 1, wherein pressure detection means for discontinuing the operation of the internal combustion engine upon detecting a pressure drop of oil occurring along with an inclination of the engine body is attached to the engine body to detect the pressure drop to discontinue the operation of the internal combustion engine before the valve element closes the valve hole at the time of the inclination of the engine body.

10. The breather structure for the internal combustion engine according to claim 2, wherein pressure detection means for discontinuing the operation of the internal combustion engine upon detecting a pressure drop of oil occurring along with an inclination of the engine body is attached to the engine body to detect the pressure drop to discontinue the operation of the internal combustion engine before the valve element closes the valve hole at the time of the inclination of the engine body.

11. A breather structure for an internal combustion engine comprising:

a breather hole provided in an engine body for mitigating the pressure in the engine body;

a valve hole provided in the engine body to communicate with an inner end portion of the breather hole, said valve hole being open to within the engine body;

a valve seat formed on an inner surface of the engine body to coaxially surround the valve hole;

a guide sleeve coaxially communicating with the valve hole and the valve seat and secured to the engine body at one end portion;

a substantially ball shaped valve element with a predetermined weight and received to be rollable in the guide sleeve for enabling the closing of the valve hole when seated on the valve seat, said substantially ball shaped valve element being prevented from falling off the other end of the guide sleeve; and the ball valve is provided in the engine body wherein the valve hole is positioned in a moving range of oil in the engine body depending on an inclination of the engine body; and a damping member for limiting a movement of the valve element towards a side to open the valve hole and for absorbing a vibration of the valve element, said damping member being fixedly placed to abut on the valve element moved within the guide sleeve.

12. The breather structure for the internal combustion engine according to claim 11, wherein an escape valve, that opens when a maximum internal pressure increase within the engine body with the operation of the internal combustion engine, is provided in the engine body to bypass the ball valve and to be interposed between the inside of the engine body and the breather hole.

13. The breather structure for the internal combustion engine according to claim 11, wherein the opening area of the valve hole and the dimensions of the valve element are set so that a weight of the valve element moves the valve element to a position to open the valve hole even in a state wherein the maximum internal pressure increases within the engine body with the operation of the internal combustion engine.

14. The breather structure for the internal combustion engine according to claim 11, wherein a breather gas circulation hole located closer to the valve hole than the valve element in a state wherein the valve element moves to the side to open the valve hole is provided in a peripheral wall of the guide sleeve to communicate with the inside of the engine body.

15. The breather structure for the internal combustion engine according to claim 11, wherein the engine body mounted on a vehicle to take an ordinary posture with the vehicle grounded on a horizontal road surface includes:

a cylinder section with a cylinder axis extending vertically in the ordinary posture; and a power transmission case section incorporating a power transmission mechanism and connected to a lower part of the cylinder section in the ordinary posture to project from the lower part of the cylinder section toward one lateral side; and wherein when viewed in a projected plan onto a plane orthogonal to an axis of a crankshaft rotatably supported in the engine body, an axis of the guide sleeve fixed to an upper part of the cylinder section in the state of the engine body being in an ordinary posture is placed to be inclined toward the power transmission case section side and to extend in a direction crossing the cylinder axis.

16. The breather structure for the internal combustion engine according to claim 11, wherein pressure detection means for discontinuing the operation of the internal combustion engine upon detecting a pressure drop of oil occurring along with an inclination of the engine body is attached to the engine body to detect the pressure drop to discontinue the operation of the internal combustion engine before the valve element closes the valve hole at the time of the inclination of the engine body.

* * * * *